United States Patent [19]

Mason et al.

[11] Patent Number: 4,805,361

[45] Date of Patent: Feb. 21, 1989

[54] THERMO TEX

[76] Inventors: Alan R. Mason, 4261 Grange Hall Rd. #60, Holly, Mich. 48442; George Spector, 233 Broadway RM 3815, New York, N.Y. 10007

[21] Appl. No.: 115,382

[22] Filed: Nov. 2, 1987

[51] Int. Cl.[4] ..... B60R 27/00

[52] U.S. Cl. ..... 52/169.12; 52/241; 52/775; 52/DIG. 3

[58] Field of Search ..... 52/DIG. 3, 169.12, 241, 52/242, 775

[56] References Cited

U.S. PATENT DOCUMENTS

| | | | |
|---|---|---|---|
| 3,553,323 | 8/1973 | Nesbitt | 52/169.12 |
| 4,043,088 | 8/1977 | Payton | 52/169.12 |
| 4,107,888 | 8/1978 | Krueger | 52/169.12 |
| 4,549,378 | 10/1985 | Ayers et al. | 52/169.12 |
| 4,635,418 | 1/1987 | Hobgood | 52/239 |

*Primary Examiner*—Carl D. Friedman

[57] ABSTRACT

A skirting system for enclosing an air space beneath a mobile home is provided and consists of a plurality of insulation material panels that are fitted into upper and lower tracks with VELCRO between the panels to resist separation so as to make it cooler in summer and warmer in winter. Corner members are also installed to finish the skirting system into a streamlined and attractive product.

3 Claims, 1 Drawing Sheet

THERMO TEX

BACKGROUND OF THE INVENTION

The instant invention relates generally to mobile homes and more specifically it relates to a skirting system for enclosing an air space beneath a mobile home.

Numerous mobile homes have been provided in prior art that are adapted to include skirting assemblies installed beneath the mobile homes in order to prevent drafts underneath and to improve the appearance thereof. For example, U.S. Pat. Nos. 3,753,323; 4,107,888 and 4,549,378 all are illustrative of such prior art. While these units may be suitable for the particular purpose to which they address, they would not be as suitable for the purposes of the present invention as heretofore described.

SUMMARY OF THE INVENTION

A primary object of the present invention is to provide a skirting system for enclosing an air space beneath a mobile home that will overcome the shortcomings of the prior art devices.

Another object is to provide a skirting system for enclosing an air space beneath a mobile home that includes a plurality of insulation material panels fabricated out of all weather plastic for water vapor barrier protection thus making it cooler in summer and warmer in winter.

An additional object is to provide a skirting system for enclosing an air space beneath a mobile home in which the finished product is streamlined and attractive to the eye, yet simple enough for the average person to be able to apply alone.

A further object is to provide a skirting system for enclosing an air space beneath a mobile home that is simple and easy to use.

A still further object is to provide a skirting system for enclosing an air space beneath a mobile home that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
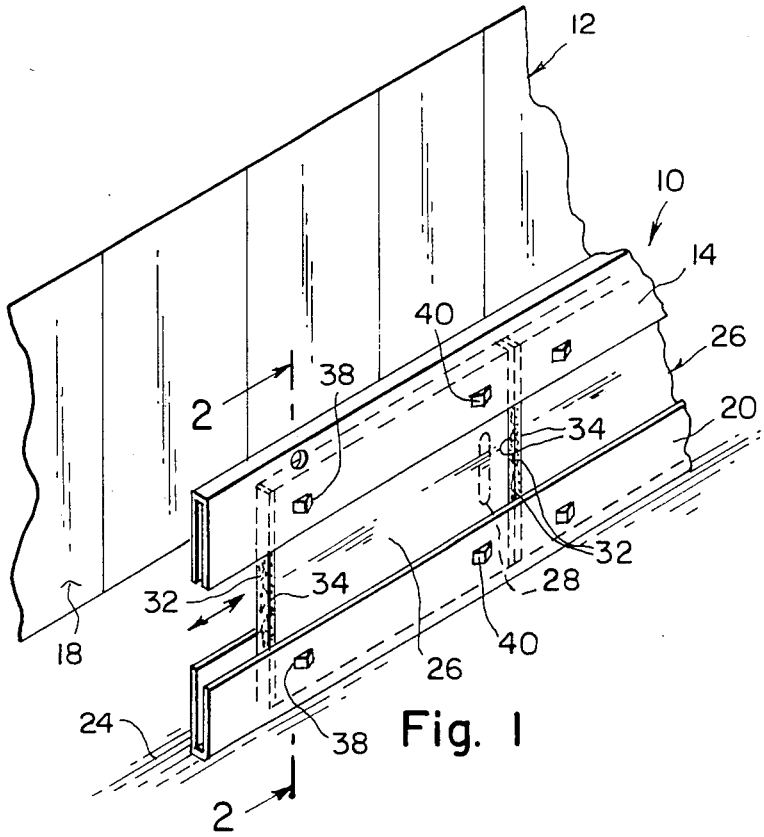
FIG. 1 is a perspective view of the invention installed to a mobile home.
Figure 2:
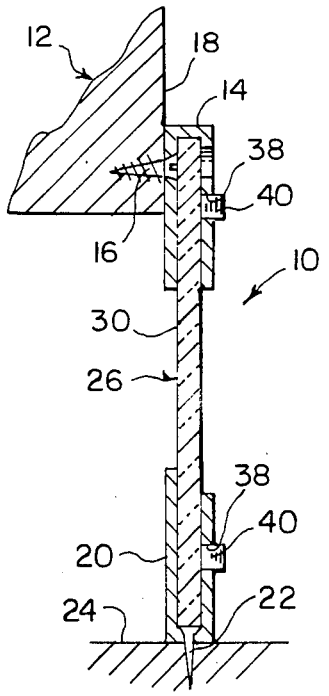
FIG. 2 is a cross sectional view taken along line 2—2 in FIG. 1.

Turning now descriptively to the drawings, in which similar reference characters denote similar elements throughout the several views, FIGS. 1 and 2 illustrate a skirting system 10 for enclosing an air space beneath a mobile home 12 that consists of an elongated upper track 14 mountable with scres 16 to exterior 18 of the mobile home 12. An elongated lower track 20 is mountable with stakes 22 to a support surface 24, such as a concrete pad or apron. A plurality of insulation material panels 26 are provided, each of which has a grooved grip 28 formed on rear surface 30 thereof for assisting the panels 26 to slide into the upper and lower tracks 14 and 20. A plurality of hook and loop fastener strips 32 are also provided. Each of the strips 32 is affixed to one side edge 34 of each of the panels 26 to hold the mating side edges 34 of the panels 26 together. The panels are maintained in an enclosing position about the mobile home 12 for a water vapor barrier protection thus making it cooler in summer and warner in winter.

Figure 7:
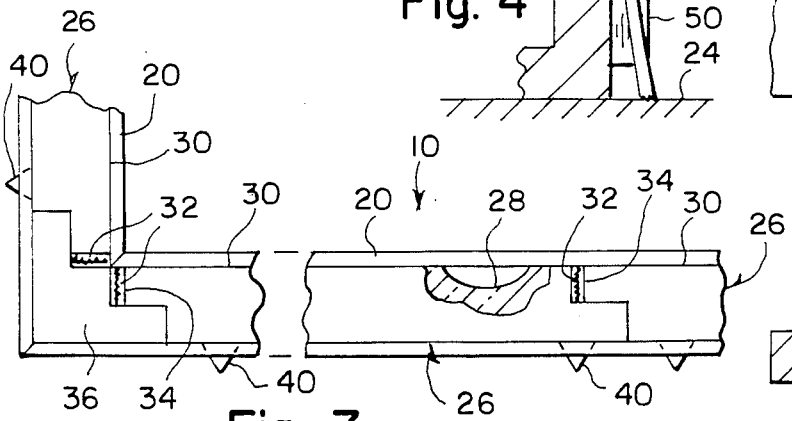
FIG. 7 is a top view of the panels just in the lower track and a corner member in place with parts broken away.

The skirting system 10 further contains a plurality of vertical corner members 36 one of which is shown in FIG. 7. The corner member 36 includes the hook and loop fastener strips 32 for engagement with the mating strips 32 on the side edges 34 of the adjacent panels 26 at a corner of the mobile home in oppositely oriented conterminous relationship. The side edge 34 can be stepped as shown so as to hide the strips 32 in back.

Figure 3:
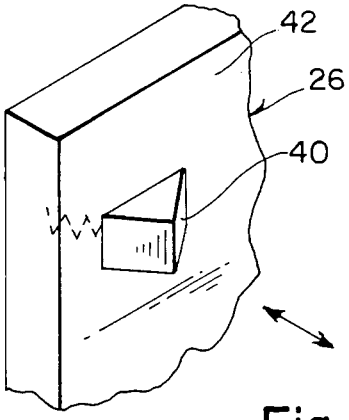
FIG. 3 is an enlarged perspective view of a top corner of the panel showing the double bevel push button in greater detail.

The upper and lower tracks 14 and 20 can optionally have a plurality of spaced apart apertures 38 formed in front thereof. Each of the panels 26 can also optionally have four double bevel spring biased push buttons 40. Each push button (see FIG. 3) is placed into each front corner 42 thereof, whereby when the panel 26 slides into the upper and lower tracks 14 and 20 the push buttons 40 will enter the respective apertures 38 to lock therein.

Figure 4:
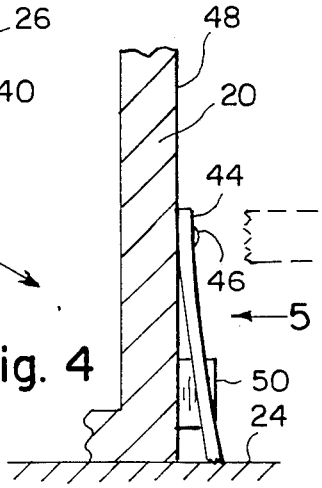
FIG. 4 is a side view of the bottom track with parts broken away showing a pivotable support arm with a wedge on front surface thereof.
Figure 5:
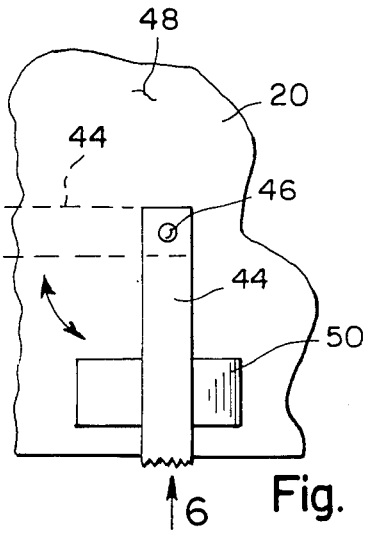
FIG. 5 is a front view taken in direction of arrow 5 in FIG. 4.
Figure 6:
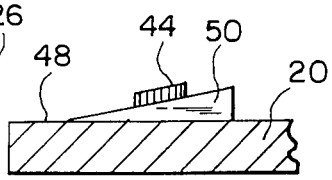
FIG. 6 is a bottom view taken in direction of arrow 6 in FIG. 5.

FIGS. 4, 5 and 6 show a support arm 44 pivotable on pin 46 to front surface 48 of the lower track 20. A wedge member 50 is formed on the front surface 48 of the lower track 20 and positioned so that when the support arm 44 pivots down to make contact with the support surface 24, lower portion of the support arm 44 will move away from the front surface 48 of the lower track 20 by bearing against the wedge member 50. Support arms 44 can be on the front and back surface of the lower track 20 and spaced apart therealong.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A skirting system for enclosing an air space beneath a mobile home comprising:

(a) an elongated upper track mountable to exterior of the mobile home;

(b) an elongated lower track adapted to be secured on a support ground surface;

(c) a plurality of insulation material panels, each of which having a groove formed on a rear face to serve as a hand grip; and (d) a plurality of hook and loop fastener strips each of which is affixed to one side edge of each of said panels to hold said side edges of said panel together whereby said panels are maintained in an enclosing position about the mobile home for a water vapor barrier protection thus making it cooler in summer and warmer in winter, further comprising a plurality of vertical corner members, each of which includes mating hook and loop fastener strips for mating engagement with the first said strips on the side edges of adjacent panels at right angles to each other at a corner of the mobile home.

2. A skirting system as recited in claim 1, further comprising:

(a) said upper and lower tracks having a front side and a plurality of spaced apertures formed in said front side; and (b) each of said panels having four corners and four double bevel spring biased push buttons, each said push buttons being located at each of said corners, whereby when said panel slides into said upper and lower tracks said push buttons will enter respective said apertures to lock therein.

3. A skirting system as recited in claim 2, further comprising:

(a) a support arm pivotable to front surface of said lower track; and (b) a wedge member formed on the front surface of said lower track and positioned so that when said support arm pivots down to make contact with the support surface, lower portion of said support arm will move away from the front surface of the lower taack by bearing against said wedge member.

* * * * *